United States Patent [19]

Haase et al.

[11] Patent Number: 4,487,552

[45] Date of Patent: Dec. 11, 1984

[54] DYNAMIC-PRESSURE MACHINE FOR CHARGING INTERNAL-COMBUSTION ENGINES

[75] Inventors: Werner Haase, Waldshut, Fed. Rep. of Germany; Andreas Mayer, Niederrohrdorf, Switzerland

[73] Assignee: BBC Brown, Boveri & Company, Limited, Baden, Switzerland

[21] Appl. No.: 318,126

[22] Filed: Nov. 4, 1981

[30] Foreign Application Priority Data

Nov. 4, 1980 [CH] Switzerland ..... 8188/80

[51] Int. Cl.[3] ..... F04F 11/00

[52] U.S. Cl. ..... 417/64

[58] Field of Search ..... 417/64; 60/39.45 A, 60/39.32, 39.31; 123/559; 418/83; 415/135; 403/28, 29, 30

[56] References Cited

U.S. PATENT DOCUMENTS

| | | | |
|---|---|---|---|
| 3,055,577 | 9/1962 | Vickery | 417/64 |
| 3,291,379 | 12/1966 | Herger et al. | 417/64 |
| 3,905,713 | 9/1975 | Black | 418/83 X |
| 4,207,807 | 6/1980 | Takata et al. | 403/30 X |
| 4,269,570 | 5/1981 | Rao | 417/64 |

*Primary Examiner*—Edward K. Look

*Attorney, Agent, or Firm*—Burns, Doane, Swecker & Mathis

[57] ABSTRACT

At least the rotor housing and the rotor of the dynamic-pressure machine comprises ceramic materials. To compensate the different thermal expansions of the ceramic components and metal components the connecting arrangements are elastically resilient essentially parallel to the rotor axis, to such an extent that the positive locking of the connecting arrangements is maintained over the entire temperature range occurring during operation, without the compressive strength of the ceramic components being exceeded.

9 Claims, 17 Drawing Figures

DYNAMIC-PRESSURE MACHINE FOR CHARGING INTERNAL-COMBUSTION ENGINES

BACKGROUND AND SUMMARY OF THE PRESENT INVENTION

The present invention relates to a dynamic-pressure machine for charging internal-combustion engines.

The measures by means of which attempts are made to improve the efficiency of dynamic-pressure machines include reducing the plays between the end faces of the rotor body and the gas housing or the air housing. To keep the leakage losses as low as possible, attempts are made to keep these plays as small as possible, and these should remain as constant as possible over the entire operating range.

Attempts are made to ensure that these conditions are adhered to, by selecting suitable materials which are co-ordinated with one another in respect of their coefficients of thermal expansion, but which, at the same time, have to withstand the thermal and dynamic stresses occurring during operation. This is especially true of the rotor for which only high-temperature materials are suitable.

Till recently, among other things an Invar alloy of high heat resistance and, up to a temperature of approximately 350° C. (the Curie point), of uniformly low coefficient of thermal expansion has proved suitable for this purpose. However, above this temperature the coefficient of thermal expansion increases abruptly, so that the charging efficiency decreases sharply unless special constructive measures making production more expensive are taken. Consequently, this alloy is suitable only to a limited extent for these higher temperatures. In the striving for even higher exhaust-gas temperatures, for example in gasoline engines, even special alloy steels or metallic superalloys no longer meet the requirements mentioned.

The demand for as small plays as possible between the rotating and the stationary components over the entire load range of the engine can be met only very inadequately with the materials used hitherto for this purpose. For in the case of rapid load changes, the rotor always undergoes the quickest temperature change and, consequently, change in diameter and length. The other parts experience the change in temperature and, consequently, in their dimensions with a delay, so that the plays can temporarily be cancelled completely—during acceleration, the rotor thus beginning to scrape, or—during throttling—the rotor cools more quickly, the plays consequently become temporarily very large and the efficiency decreases accordingly.

To keep these changes in play within as narrow limits as possible, the wall thickness of the rotor housing is made as thin as possible, so that the latter is heated and cooled rapidly during load changes and can consequently follow sufficiently quickly the rapid changes in length and diameter of the rotor. However, small wall thicknesses of the rotor housing signify greater heat losses and therefore a loss of efficiency.

The present invention arose from the object of finding a design for the rotor and the rotor housing of a dynamic-pressure machine, in which the disadvantages described above are avoided. In other words, under all operating states and especially during load changes, uniformly low values are maintained for the plays between the rotor end faces and the end faces of the gas or air housing, in order to prevent scavenging losses or scraping, and in which, because of a higher thermal loading capacity, a greater efficiency can be obtained and better acceleration ability is achieved.

This is put into practice, according to the invention, by the use of ceramic materials for the rotor and the housing and by a constructive shaping, adapted to the properties of this material which is novel for dynamic-pressure machines, of these parts and of the means for connecting them to the rotor shaft or to the gas and the air housing.

BRIEF DESCRIPTION OF THE DRAWINGS

The invention is described in more detail below with reference to preferred embodiments illustrated in the drawing in which.

DETAILED DESCRIPTION OF THE PREFERRED EMBODIMENTS

Figure 1:
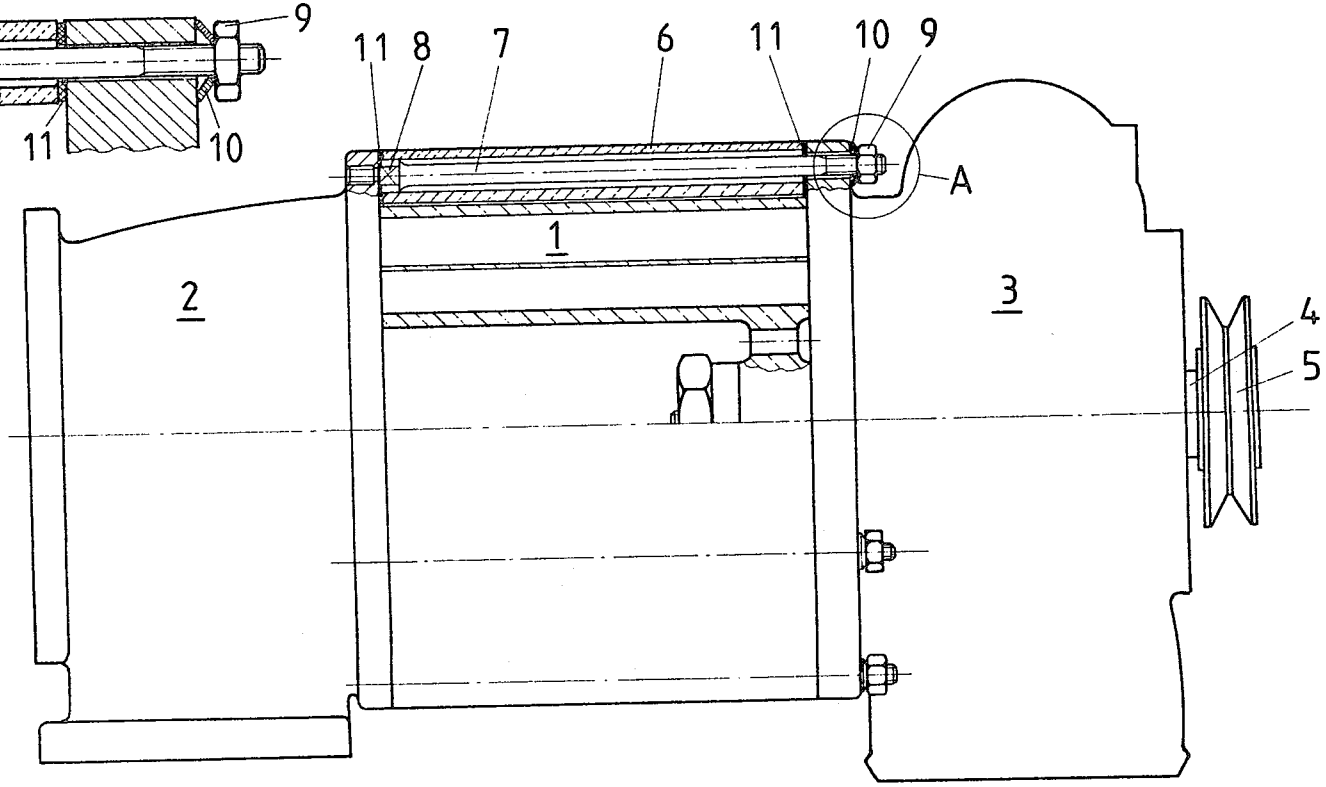
FIGS. 1, 3 and 4 are partial cross-sectional views of three embodiments of dynamic-pressure machines according to the invention.
Figure 3:
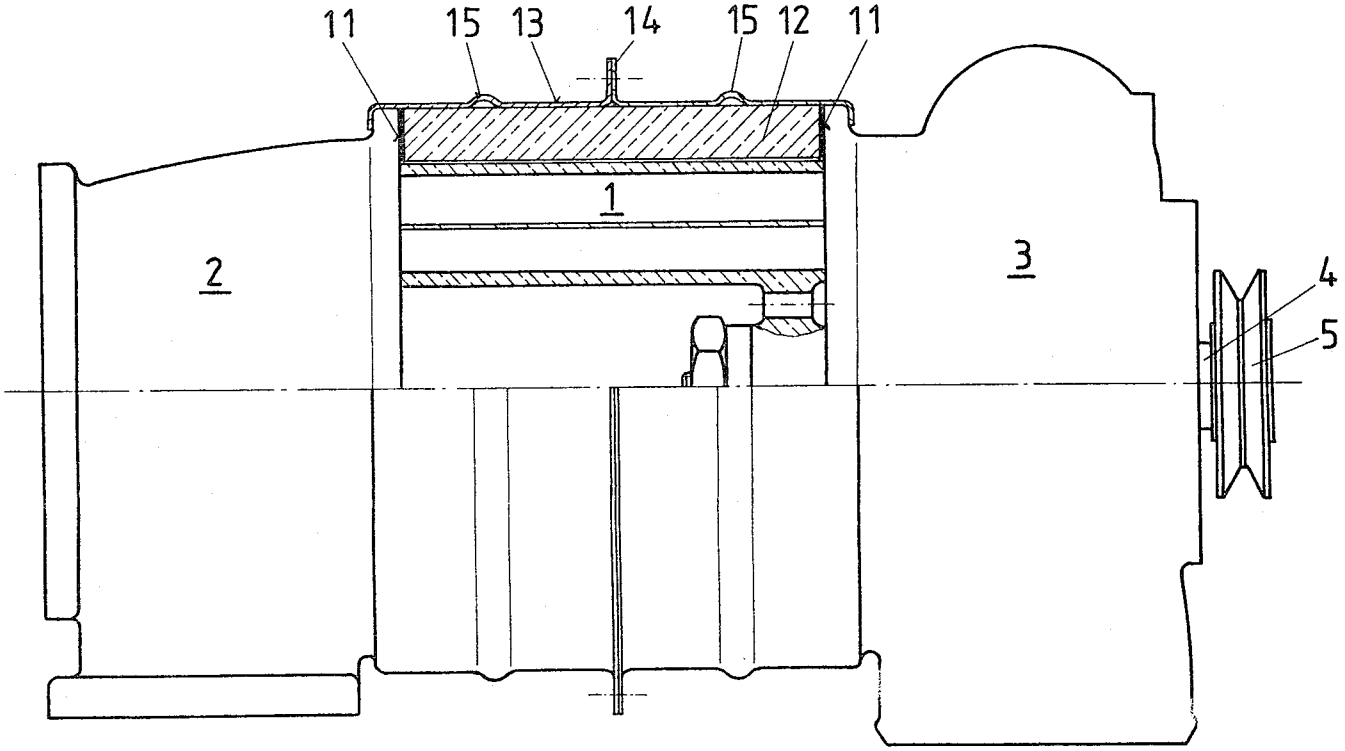
Figure 4:
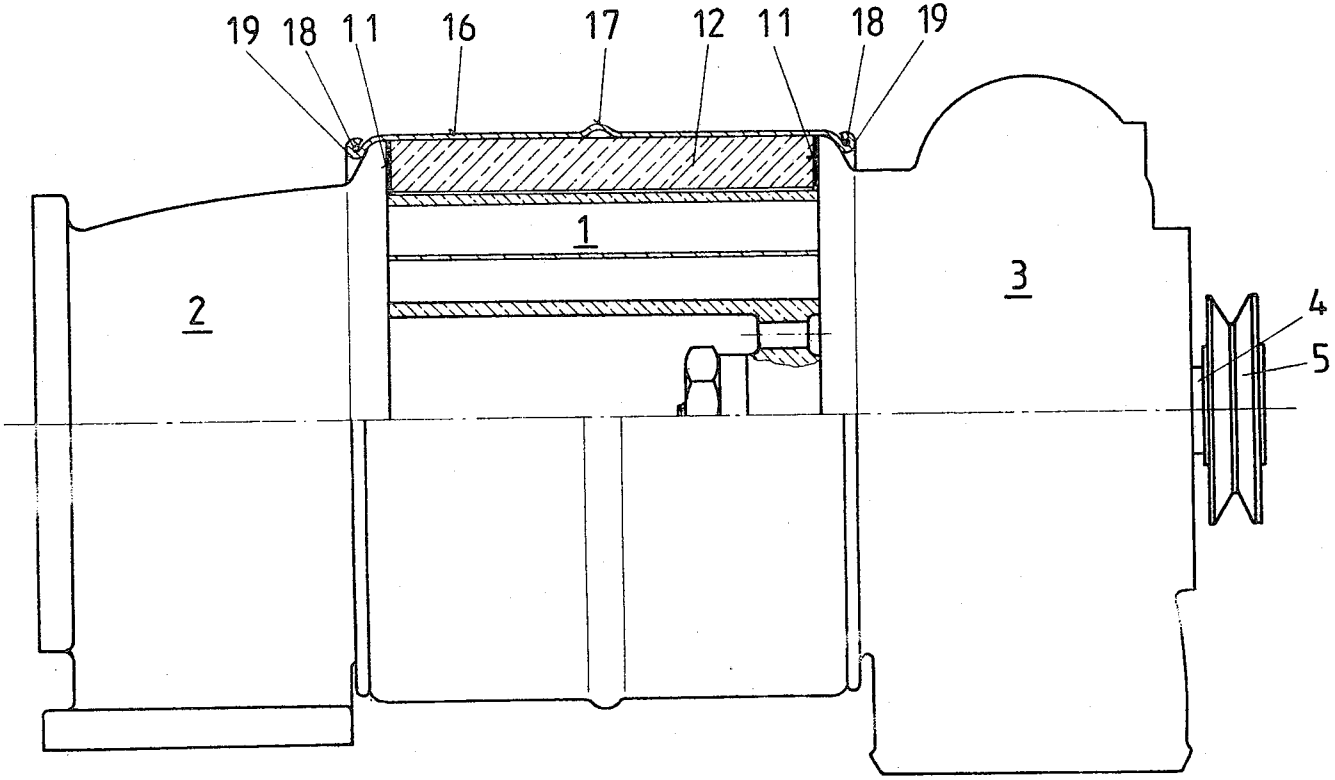

In FIG. 1 as well as FIGS. 3 and 4, the gas housing 2 for feeding and discharging the exhaust gases of the engine respectively into and out of the rotor 1 and the air housing 3 for sucking in the combustion air and feeding the compressed charging air into the engine are illustrated. The rotor 1 is overhung in the air housing 3 by means of its rotor shaft 4. Outside this housing, a V-belt pulley 5 sits on the shaft end for the positive drive of the rotor 1 by the engine.

Just like the rotor housing 6 surrounding it, the rotor 1 consists of ceramic material, for example reaction-sintered silicon nitride ceramic or silicon carbide, which, after the pressing, casting or extrusion and drying of the green article. In other words, the crude unbaked molding, is baked and subjected to a chemical hardening process in a known way. In comparison with a rotor housing made of metal, this housing 6 made of ceramic presents the problem, because of the different coefficients of thermal expansion of the housing material and of the metallic connecting elements by which the housing 6 is connected to the metal gas housing 2 and air housing 3, of designing these connecting elements in such a way that unduly high thermal stresses, especially tensile stresses in the ceramic, as a result of expansion differences are reliably prevented.

Figure 2:
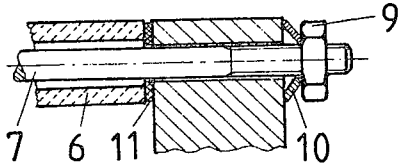
FIG. 2 is an elongated view of a portion of the design according to FIG. 1, FIGS. 5 to 8 are views of two exemplary embodiments of the sealing of the junction point between the rotor housing and the air or gas housing.

In the design of the housing according to FIG. 1, these connecting means consist of expansion stud bolts 7 which are distributed at equal intervals over the periphery and have threads at both ends. The stud bolts 7 are provided at the screw-end with a collar 8 having spanner faces for tightening and bracing against the gas housing 2. As indicated more clearly by the cut-out portion A shown in larger scale in FIG. 2, a cup spring 10 is provided under the nut 9 at the free threaded end by which the air housing 3 is screwed to the rotor housing 6, this cup spring compensating the expansion differences occurring during operation between the expansion stud bolts 7 and the rotor housing 6.

As a result of elastic connecting means 7, 9, 10, a constant positive locking between the two end faces of the housing 6 and the gas housing 2 and air housing 3 is guaranteed in the axial direction and unduly high stresses are prevented from occurring, but the relative displacement between the end faces of the gas housing and air housing, on the one hand, and the two end faces of the housing 6 is not significantly impeded. In this design, the rotor housing 6 consists of a simple circular-cylindrical shell with the longitudinal bores for the expansion stud bolts 7. Making such a shell from ceramics presents no difficulties of any kind. Even economical extrusion would be suitable for this in the case of mass production.

Ductile metal sealing rings 11 are provided for sealing purposes on the two end faces of the rotor housing and permit unimpeded radial displacement of the faces of the sealing ring against the metal seat of the gas or the air housing. Instead of such separate rings, a ductile metal layer can also be sprayed onto the end faces of the ceramic rotor housing 6. To make it easier for them to move radially relative to one another, these seats could be treated with a lubricant. As a result, harmful distortions caused by different radial expansions of the metal gas or air housing relative to the ceramic rotor housing can be avoided.

The production of a ceramic rotor housing 12 is even simpler in the design according to FIG. 3. This rotor housing is formed by a simple circular-cylindrical tube. A two-part clamping sleeve 13 serves, here, for connecting the rotor housing 12 to the gas housing 2 and air housing 3, the two parts of this clamping sleeve being drawn together, under prestress, in the longitudinal direction by screws indicated by their center line and by flanges 14. To compensate for thermal expansions during operation, the two halves of the clamping sleeve are provided with resilient peripheral beads 15, as a result of which undue longitudinal stresses are prevented from occurring. To permit assembly with the gas housing and the air housing, the two halves of the clamping sleeve are also divided in the longitudinal direction. The two margins of the partition gap are connected to one another in a known way (not shown), for example by screws or tightening straps.

In the design of a dynamic-pressure machine according to FIG. 4, which also has a circular-cylindrical rotor housing 12, there is a likewise two-part clamping sleeve 16 divided in the longitudinal direction. For compensating the longitudinal expansions, the sleeve 10 possesses a single peripheral bead 17, and is fastened by means of bracing wires 18 which are located in hollow beads 19 at the two margins of the clamping sleeve. The bracing wires 18 are drawn round the connecting flanges of the gas housing 2 and of the air housing 3 respectively by known means (not shown), for example clamping screws or turnbuckles, and cause axial bracing of the housings 2 and 3 against the rotor housing 12.

The clamping sleeves 13 and 16 each provide, at the same time, protection for the ceramic rotor housing which is sensitive to shocks.

Figure 5:
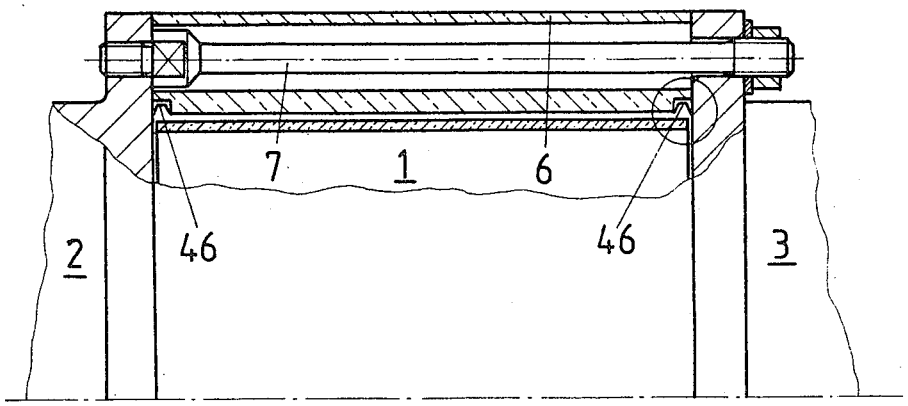
Figure 6:
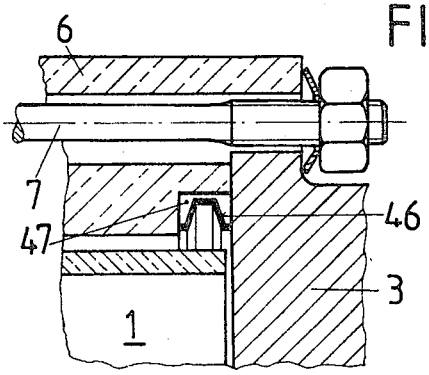

FIGS. 5 and 6 show sealing of the joints between the rotor housing 6 and the gas housing 2 or air housing 3 by double-lipped sealing rings 46 which, as indicated more clearly in FIG. 6, are embedded in grooves 47 on the inner side of the rotor housing 6. Because of their great elasticity, these sealing rings 46 adapt extremely well to all changes in the groove dimensions caused by heat. Also, the rings 46 do not contribute to impeding the radial displacement of the rotor housing 6 relative to the gas housing or the air housing as a result of the different thermal expansions of these parts.

Figure 7:
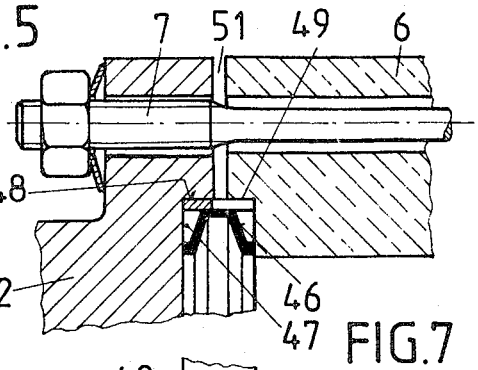
Figure 8:
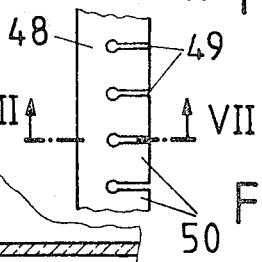

An alternative form of this sealing, illustrated in FIG. 7, has a compensating ring 48, part of the developed view of which is shown in FIG. 8. On the side facing the rotor housing 6, its periphery is divided up by a series of slits 49 into elastic tabs 50 which permit easy radial displaceability between the gas or the air housing and the rotor housing. This easy displaceability is guaranteed, in addition, by the fact that the ring acts as a spacer ring which leaves a gap 51 free between the end faces of the housing and the air or gas housing. Any friction between the end faces is therefore prevented.

Figure 10:
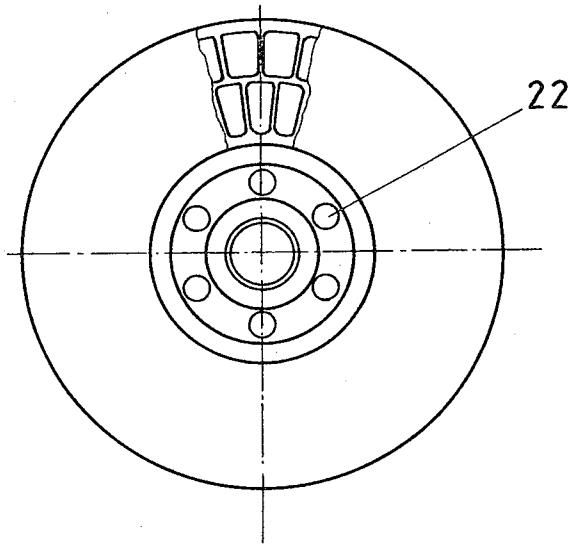
FIGS. 9 and 10 are views of a rotor of the design according to the invention, in a longitudinal section and in a side view, respectively
Figure 9:
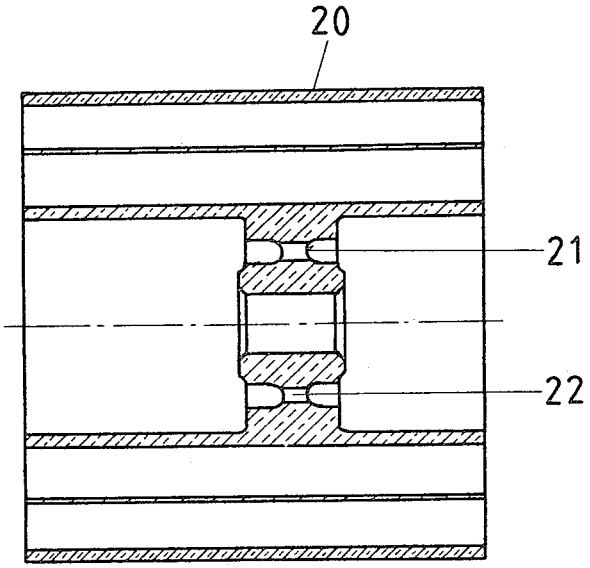

An embodiment of a double-flow ceramic rotor 20 which can be paired with a ceramic rotor housing is shown in FIGS. 9 and 10 in an axial cross-section and in a side view respectively, only a few of the channels being indicated in the latter for the sake of simplicity.

In this rotor, the flow passages and the hub are made in one piece. To reduce the weight, the hub can be designed with a web 21 and have holes 22. The connection of the hub to the shaft will be discussed in relation to the rotor designs according to FIGS. 11 to 17.

In these rotors, the hubs are produced separately from the rotor body, which is designed here in all cases with a double flow, and are connected ceramically to the latter, so that in mass production these rotor bodies can be made by extrusion in an economical way.

Figure 11:
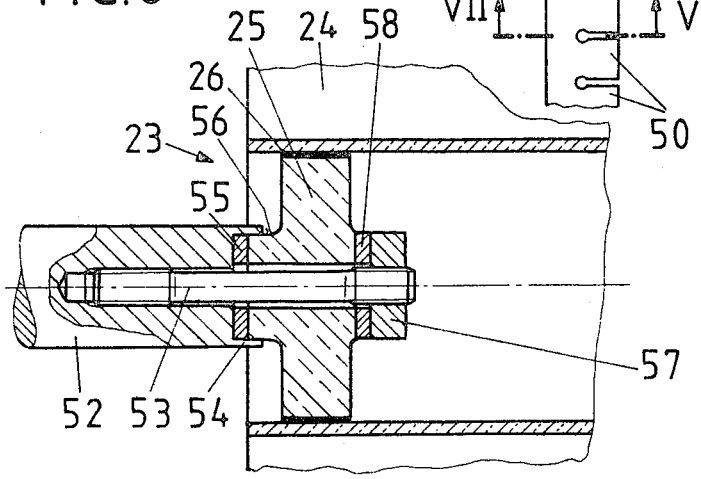
FIGS. 11 to 17 are partial cross-sectional views of various embodiments for connecting the rotor made of ceramic to its drive shaft made of steel in a manner appropriate to the material.

In the rotor 23 illustrated in FIG. 11, the rotor hub 25 is inserted without a stop into the bore of the rotor body 24, this bore being of equal size throughout. The connecting joint 26 connects the rotor body 24 to the rotor hub 25.

The metal shaft 52 is always connected to the rotor body with the knowledge that significant tensile stresses must be prevented in the ceramic components. For this purpose, an expansion bolt 53 screwed in the shaft 52 is provided here along with a centering ring 54 formed by a recess turned on the shaft end. The centering ring 54 serves for centering the shaft relative to the rotor. An adjusting washer 55 within the centering ring 54 serves, in each particular case, by an appropriate dimensioning of its thickness, to set the exact axial position of the rotor body 24 in relation to the inner end faces of the gas housing and the air housing and, consequently, the axial movement play of the rotor relative to these end faces. The centering of the rotor hub 25 relative to the shaft 52 is effected by the centering ring 54, interacting with an outer face 56 of the hub 25, this face being ground concentrically relative to the outside diameter of the rotor body 24. A nut 57 with a washer 58 serves for fixing the rotor body axially.

Figure 12:
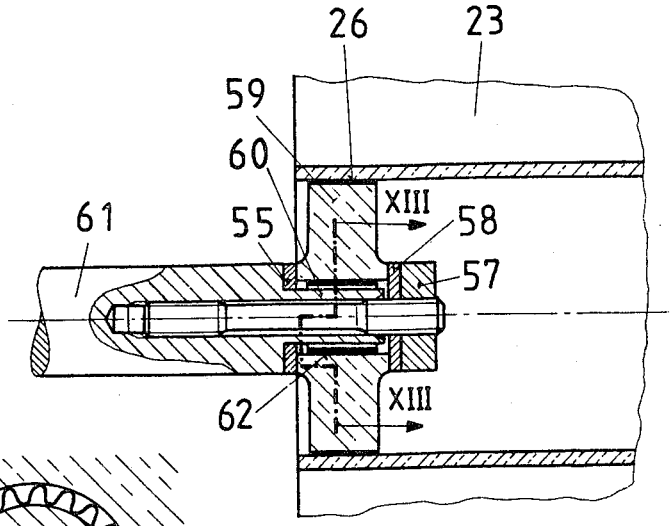
Figure 13:
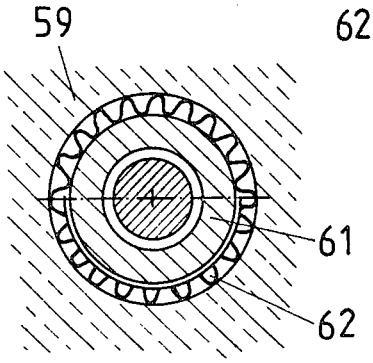

In the connection illustrated in FIG. 12, a conventional so-called "tolerance ring" 62, shown on a larger scale in FIG. 13, serves for centering the hub 59 on a centering pin 60 of the shaft 61. This tolerance ring 62 has radially flexible longitudinal beads parallel to its axis, which form as a whole a corrugated cross-section evident from FIG. 13. The circumscribed circle and the inscribed circle of this cross-section have a slight overmeasure and undermeasure respectively in relation to the hub bore and the shaft respectively. During assembly, the inner and outer peaks of the beads are deformed and result in a weak centering press fit which subjects the ceramic material of the hub to only slight tension in accordance with the requirement mentioned above. As in the preceding example, an adjusting washer 55, a nut 57 and a washer 58 serve for setting the lateral movement plays of the rotor and for fixing the latter axially on the shaft.

Figure 14:
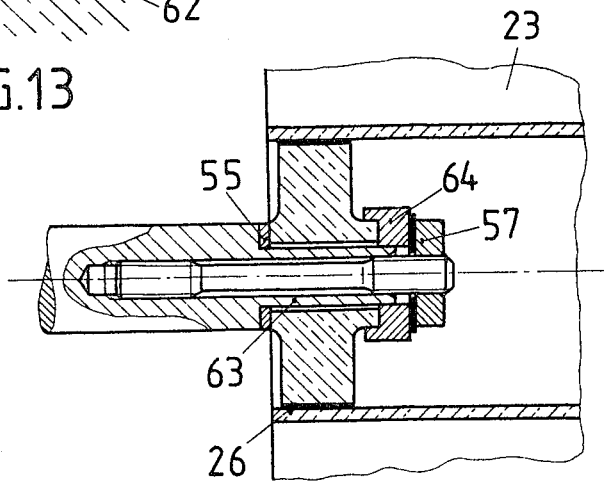

In the connection according to FIG. 14, a centering washer 64 sitting with a close fit on a centering pin 63 is provided for centering the rotor hub relative to the shaft axis, and this is, again, in conjunction with an adjusting washer 55 and a nut 57.

Figure 15:
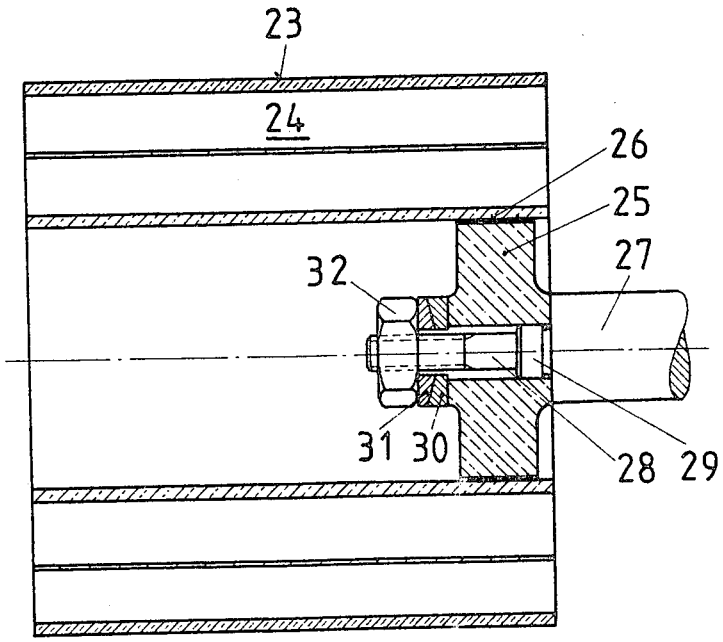

In the arrangement according to FIG. 15, the shaft 27 is connected to the rotor 23 by an expansion bolt 28 screwed in the shaft, a centering pin 29 provided on the shaft end, a pair of washers 30, 31 with interacting concave and convex crowned faces respectively, and a nut 32. An adjusting washer may also be necessary in a similar way to the connections described before.

Figure 16:
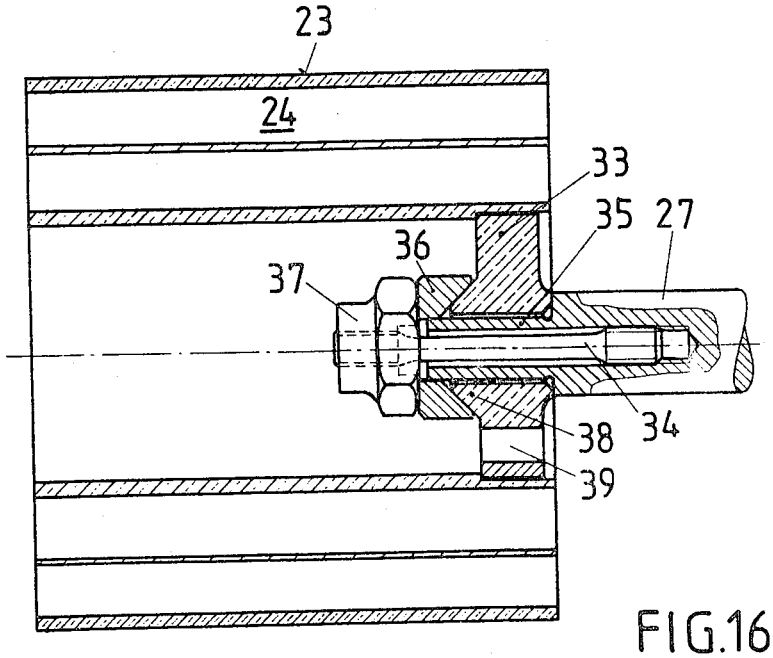

The connection, illustrated in FIG. 16, of the shaft 27 to the rotor 23, which again comprises the double-flow rotor body 24 and a hub 33, likewise has an expansion bolt 34. Here, the shaft 27 is centered relative to the hub 33 by a long centering pin 35 having play relative to the bore of the hub 33, and a washer 36 with an inner cone, which sits free of play on the centering pin 35 and is braced by a nut 37 against a truncated cone-shaped projection 38 of the hub 33.

To lighten the weight, the hub 33 can be provided with holes 39 or other cut-out portions.

Figure 17:
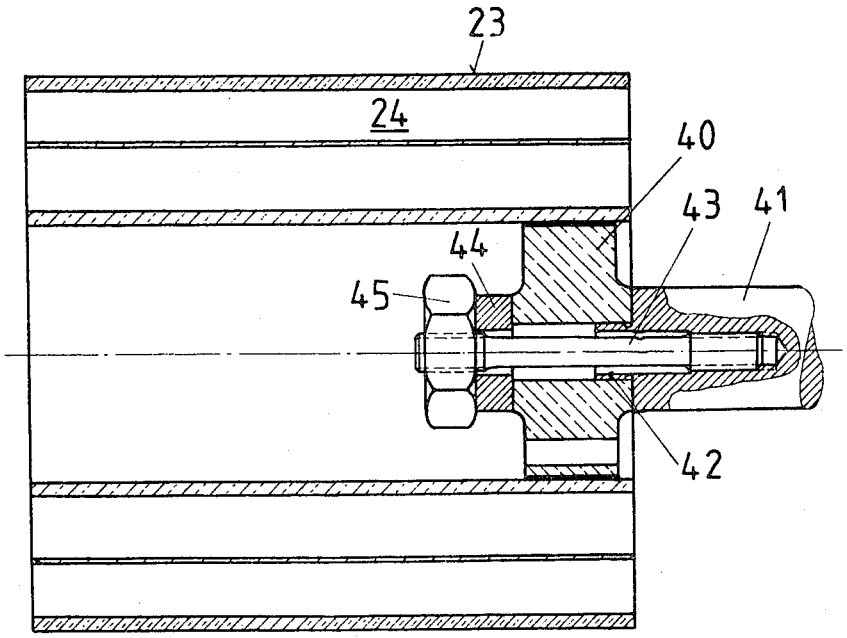

In the connection of the hub 40 and shaft 41, as illustrated in FIG. 17, the hub is centered relative to the shaft by a short centering pin 42 and is braced by an expansion bolt 43, a plane-parallel washer 44 and a nut 45. Even in these last two mentioned arrangements, adjusting washers may be necessary, depending on the production accuracy.

The constructive measures described above afford for the rotor, in addition to the thermodynamic gain mentioned in the introduction, also the advantage that the density of the ceramic at $\rho=2.4$–$3.2$ g/cm$^3$ is only 30–40% of the density of those metals which are used at present for rotors. The mass moment of inertia and, consequently, the non-stationary torques of the ceramic rotor are less in the same ratio. The acceleration ability of the engine is therefore improved. Consequently, the initial tension and slip of the belt, that is to say, the belt stress and the bearing load of the dynamic-pressure machine, are correspondingly lower.

Since, in a dynamic-pressure machine, the hot gas and the cold air come into contact with the same rotor, a regenerative heat exchange which impairs efficiency, occurs between the rotor and the charging air. In the case of the ceramic rotor, the regenerative heat exchange between the rotor and the charging air, and, consequently, the loss of efficiency are less because of the lower specific heat capacity of ceramic materials.

In general, lower material costs than in the case of metal superalloys can also be expected when ceramic materials are used for mass production.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. In a dynamic pressure machine for charging a combustion engine having a rotor housing, a rotor located within the housing carried by a metal rotor shaft for compressing combustion air by means of enging exhaust gases, and an exhaust gas housing and an air housing each of which close a corresponding end face of the rotor housing, the improvement comprising:

the rotor and the surrounding rotor housing being fabricated of ceramic material;

first connecting means for connecting the rotor to the metal rotor shaft and second connecting means for connecting the rotor housing to the gas housing and air housing, at least the second connecting means including resilient elements which exert a prestressing force on the connected parts, the force acting parallel to the axis of the rotor shaft and being operable over the entire operating temperature range of the machine;

the ceramic rotor housing is a circularly cylindrical shell with bores parallel to its axis; and the second connecting means for connecting the rotor housing to the gas housing and air housing includes bolts which are received in corresponding bores of the rotor housing, the resilient elements comprising a cup spring retained by a nut secured to a respective bolt; and the first connecting means between the rotor and the rotor shaft includes an elastic bolt provided on an end face of the rotor shaft, the bolt having a centering pin received by a hub bore of the rotor, at least one washer and a nut for retaining the assembly.

2. The dynamic pressure machine of claim 1, wherein:

the rotor housing is a circularly cylindrical shell;

the second connecting means for connecting the rotor housing to the gas housing and the air housing includes a two-part clamping sleeve each part of which has at least one peripheral bead and is further divided in the longitudinal direction, the two ends along the longitudinal separation being connected to one another, each of the two parts of the clamping sleeve having a beaded end portion directed radially inwards and a flange directed radially outwards, the beaded end portions resting against corresponding connecting flanges of the gas and the air housings;

the two parts of the clamping sleeve being held against one another at the flanges in the longitudinal direction by threaded fasteners; and the first connecting means for securing the rotor to the rotor shaft includes an elastic bolt on an end face of the rotor shaft, the bolt being provided with a centering pin received by the hub bore of the rotor, a washer with a conical face and a bore which fits free of play on the centering pin, the conical face of the washer being secured by a nut against a truncated cone-shaped projection of the hub.

3. The dynamic-pressure machine of claim 1, wherein:

the rotor housing is a circularly cylindrical shell;

the second connecting means for connecting the rotor housing to the gas housing and air housing includes a clamping sleeve slotted in the longitudinal direction and provided with at least one peripheral bead and hollow beads bent radially inwards, each hollow bead resting against a corresponding connecting flange of the gas housing and air housing, respectively, a peripherally tightened wire being embedded in each hollow bead; and the first connecting means for connecting the rotor shaft to the ceramic rotor includes an elastic bolt on an end face of the rotor shaft, the shaft being provided with a centering pin for the hub bore of the rotor, a plane-parallel washer, and a nut for retaining the assembly.

4. The dynamic pressure machine of claim 1, wherein:

the rotor housing and the rotor body of the rotor are made as extruded articles; and the hub of the rotor is ceramically connected, as a separate article, to the rotor body.

5. The dynamic pressure machine of claim 1, wherein:

the first connecting means for connecting the rotor shaft to the ceramic rotor includes an elastic bolt, with a nut, a washer, a centering ring provided on the end face of the rotor shaft which cooperates with a cylindrical outer face of the rotor hub, and an adjusting washer.

6. The dynamic pressure machine of claim 1, wherein:

the first connecting means for connecting the rotor shaft to the ceramic rotor includes a centering pin made integrally with the shaft, a tolerance ring, an elastic bolt with a nut and washer and an adjusting washer.

7. The dynamic pressure machine of claim 1, wherein:

the first connecting means for connecting the rotor shaft to the ceramic rotor includes a centering pin made integrally with the rotor shaft, an elastic bolt with a washer and nut, a centering washer forming a close fit with a cylindrical outer face of the rotor hub and the centering pin, and an adjusting washer.

8. The dynamic pressure machine of claim 1, further comprising:

a compensating ring which peripherally surrounds a double-lipped sealing ring, and which is subdivided by uniformly distributed peripheral slits into a plurality of elastically resilient tabs, the slits being on the side facing the rotor housing.

9. The dynamic pressure wave machine of claim 1, wherein the at least one washer includes a concave crowned washer and a convex crowned washer.

* * * * *